US010188932B1

(12) United States Patent
Fierbaugh et al.

(10) Patent No.: US 10,188,932 B1
(45) Date of Patent: Jan. 29, 2019

(54) BASEBALL AND SOFTBALL TOURNAMENT SYSTEM

(71) Applicants: Randy Fierbaugh, Palm Harbor, FL (US); Matt Bomeisl, Lutz, FL (US)

(72) Inventors: Randy Fierbaugh, Palm Harbor, FL (US); Matt Bomeisl, Lutz, FL (US)

( * ) Notice: Subject to any disclaimer, the term of this patent is extended or adjusted under 35 U.S.C. 154(b) by 0 days.

(21) Appl. No.: 15/727,835

(22) Filed: Oct. 9, 2017

(51) Int. Cl.
*A63B 71/06* (2006.01)
*A63B 69/00* (2006.01)

(52) U.S. Cl.
CPC ..... *A63B 71/0616* (2013.01); *A63B 69/0002* (2013.01); *A63B 71/0669* (2013.01); *A63B 2220/806* (2013.01); *A63B 2220/89* (2013.01)

(58) Field of Classification Search
CPC ..... A61B 71/06; A61B 71/0616
See application file for complete search history.

(56) References Cited

U.S. PATENT DOCUMENTS 4,941,662 A * 7/1990 DePerna ..... A63C 19/00 273/317.6
5,401,018 A * 3/1995 Kelly ..... A63B 63/00 473/140
5,443,260 A * 8/1995 Stewart ..... A63B 69/0002 473/421
9,597,570 B2 3/2017 Altshuler et al.
2004/0157684 A1* 8/2004 Craven, Jr. ..... A63B 71/02 473/415
2007/0265043 A1 11/2007 Wang et al.
2010/0298958 A1* 11/2010 Connelly ..... A63B 71/06 700/93
2012/0179277 A1* 7/2012 Lymberopoulos ..... A63B 71/0616 700/91
2015/0014924 A1* 1/2015 Asistin, Jr. ..... G07F 17/3276 273/148 R
2016/0074738 A1* 3/2016 Dokhanian ..... G06Q 10/0639 473/415
2017/0157484 A1* 6/2017 Altshuler ..... A63B 69/0002

* cited by examiner

*Primary Examiner* — James S McClellan
(74) *Attorney, Agent, or Firm* — Larson & Larson, P.A.; Justin P. Miller; Frank Liebenow

(57) ABSTRACT

The baseball and softball tournament system allows for completion of a large, multi-team baseball tournament in three days or less. This is accomplished by combining two elements: First, a computerized system replaces human fielders, as well as largely replacing human umpires for determining most offensive and defensive outcomes. The computerized system calls all balls/strikes, and determines base hits and outs, while also determining the probability of runs scored. Second, to encourage gameplay speed, variations of tournament rules, such as utilizing batting tees, soft toss, coach pitch, machine pitch, and team designated pitchers promote game speed, increases player and game action and reduces downtime during the contests. Also, other tournament rules such as shortening game length by determining innings played for regulation games from two innings to no more than eight innings, and other such rules help reduce the amount of time to complete the competition games.

16 Claims, 8 Drawing Sheets

BASEBALL AND SOFTBALL TOURNAMENT SYSTEM

FIELD

This invention relates to the field of sports and more particularly to a system and method of conducting a baseball or softball tournament.

BACKGROUND

Sport-competitions are a fixture of life. For the players, a sport competition is the arena in which their countless hours of practice can be put to the test, and from which they hope to emerge as a victor. For the spectators, a tournament creates endless speculation as to which factors will help a team to win, or cause them to lose, with near-immediate experimentation to see which theory proves true.

Younger players enjoy tournaments, such as from middle school to high school age, as an exciting experience and a time of camaraderie. Baseball and softball are common sports for tournaments.

Baseball as a sport has changed little since the invention of the modern baseball field in 1845 by Alexander Cartwright. But despite the recent introduction of technology into the game, amateur baseball has struggled to maintain or increase participation levels. Players leave the sport for many reasons, but in particular they leave due to: excess game length and time needed to complete a game, the need for a large number of players to play the game, the lack of actual game action, and the slow pace of play. Each has caused players to leave the game because compared to many other sports, the game has just stopped being fun.

The drawback of the current tournament system is the required investment of large blocks of time by players, parents and organizers. With increased quantities of teams, each game requires hours of time, and thus separating out the best teams takes time. The result is tournaments that are many days in length. Given the length, participation becomes limited, and thus growth of the tournament system has suffered.

In addition, baseball and softball tournaments are taxing on a particular member of the team—the pitcher. Pitching is an activity that is stressful on a player's body. Resting between pitching sessions is highly recommended by research and sports medical practitioners, but with a multi-day tournament such resting is impractical.

What is needed is a tournament system that speeds up the process of games, shortens the time it takes to complete a game, gives the players more action, combines physical elements and real-world player skills, while merging with the virtual world that has become popular in today's society. The result allows large, multi-team baseball and softball tournaments to be completed in three days or less.

SUMMARY

The disclosed system allows for completion of an entire large, multi-team baseball tournament in no more than three days. This is accomplished by combining two elements: First, a computerized system replaces human fielders, as well as largely replacing human umpires for determining most offensive and defensive outcomes. The computerized system calls all balls/strikes, and determines base hits and outs, while also determining the probability of runs scored. Second, to encourage gameplay speed, variations of tournament rules, such as utilizing batting tees, soft toss, coach pitch, machine pitch, and team designated pitchers, promote game speed, increases player and game action, and reduce downtime during the contests. Also, other tournament rules such as challenging batters with different ball/strike counts upon entering the batters box, limiting the amount of time for pitchers to throw to the batter between pitches, and other variations of tournament rules help reduce the amount of time to complete the competition games.

Finally, optionally, pitchers who also serve as players are only used for the elimination stage of the tournament, and not for the first contest stage of the tournament. Reducing the number of times the player-pitchers must pitch avoids over-taxing the player-pitcher, as well as ensuring the pitcher is well-rested, and can keep up the pace.

First, a discussion of the system that reviews and evaluates pitched balls and responses to batted balls: the Data And Predictability Probability System, or DAPP System. The DAPP System includes both hardware and software. The hardware components include a detector that is placed on the playing field. The detector includes single or multiple cameras, along with microwave, radar or laser sensors, either separately or in combination supported by a frame. Through use of this detector, the DAPP System captures the data in the form of images, video, vibration and interruptions of microwave pulses, permitting tracking of a moving object within three-dimensional space.

The detector is coupled to a controller, such as a computer including a memory and a processor. The controller receives the data, such as measurements of ball position, in the form of images from the detector, and can capture the pitched ball velocity and location, and the batted ball exit velocity and launch angle, as well as other data in order to determine the probability of strikes, balls, hits, outs and other offensive and defensive outcomes.

The controller processes the data using analytical software. By processing the data, the DAPP System can determine incoming ball speed and ball trajectory, then after the ball is hit, determine the exit ball velocity and launch angle. Using these inputs, the DAPP System calculates ball trajectory.

The ball trajectory is further processed to arrive at a predicted outcome. For example, whether a ball exits the ballpark and is a home run, or if it is a high fly ball that will not travel far, and is easily caught.

In addition to a predicted ball path, the system includes virtual fielders. The virtual fielders have performance characteristics that are integrated into the calculations to determine the time required to reach the ball location, catch or retrieve, and throw.

The performance of the virtual fielders can be adjusted based on the desired player age and skill level. For example, if the virtual fielders are standing in for grade school players, the fielders will be slower than if standing in for high school players. Furthermore, the virtual fielders can be adjusted in anticipation of certain batting behavior, such as a batter who always hits to a certain side of the field.

Based on this processing of the baseball's path and the performance of the virtual fielders, the DAPP System predicts whether the hit is a single, double, triple, home run, bunt, or out.

In addition, the disclosed DAPP System can predict stolen bases. The DAPP System calculates the probability of a stolen base by applying a calculation to the following inputs:

The identity of the players on base;

Each player's running speed based on his/her captured times for running specific ten, twenty, thirty, forty, or sixty yard sprint times; and Throw times from the pitcher to the catcher from a set position (delivery time), followed by the time for the catcher to stand up and throw to second or third base (pop time).

Based on the above inputs, the DAPP System can determine the probability of whether a player who attempts to steal a base will be determined to be safe or out.

The ability to predict a stolen base is a feature that may be enabled or disabled as desired by the tournament managers.

Turning now to the tournament more generally: The proposed tournament system can include between two teams and four thousand and ninety-six teams per division, with between two and ten divisions per tournament. The separation into divisions may be based on numerous factors, such as the players age, gender, skill level, or other relevant criteria.

The venue may be indoor or outdoor, ranging from a fairground to a convention center.

Whether a team remains in the tournament after a loss will depend on whether the tournament is set up as a single, double, round robin, pool play, or other tournament elimination format. In single elimination, a single loss removes the team from the tournament. In double elimination, a single loss allows a team to continue, but the second loss removes the team from the tournament.

In a single round-robin schedule, each team plays every other team a single time.

Pool play consists of a pre-determined number of games that are played prior to any elimination of teams. If pool play is chosen, each team is guaranteed an equal number of pool play games. For many tournaments the performance/record of each team in pool play will determine where the team is bracketed for elimination play.

Each team is made up of between one and fifteen players. Each player takes on one of the following roles:

Hitter only;

Pitcher only;

Hitter and pitcher; or

Catcher.

Pitchers are permitted a limited number of throws during the elimination stage of the tournament. This is discussed further below.

The tournament consists of two stages: a first stage of contest games to reduce the number of teams, and a second stage of elimination games to arrive at a tournament winner.

Every team plays in at least one contest game. The teams compete within their respective division to determine the final two, four, eight, or sixteen teams in each division. The decision of whether to play until either eight or sixteen teams remain is based on the size of the tournament. For larger tournaments, more teams from a given division may be permitted to continue past the contest game stage.

During the contest game stage, the pitcher may be provided by the tournament organizer. If so, the pitching may be performed by: 1) a mechanical pitching machine, where the mechanism is powered by a user-charged spring or other energy storage mechanism; 2) an electric pitching machine, where the mechanism is powered by an electric motor; 3) a batting tee; or 4) underhand soft toss for younger players may be used.

Alternatively, the pitching during the contest game stage may be performed by a Team Designated Pitcher ("TDP"). A TDP is a pitcher chosen by the team with the goal of delivering pitches the batters can hit. The TDP may be a coach, or other person affiliated with the team and each team may have multiple TDPs available during the competitions. Pitches may be of any type determined by the tournament organizers, including underhand or slow toss.

A TDP pitches against his or her team, and not against the opposing team. The TDP is not a team member, and thus does not bat.

Optionally, a minimum pitch speed is optionally set for each division, and the tournament as a whole, to equalize difficultly. Minimum pitch speed may be increased as teams are eliminated and as teams progress through the competition.

After the contest games reduce the number of teams to two, four, eight, or sixteen teams, the teams move on to the elimination games.

In elimination games, each team's goal is to lose the least games. Only one team may be the winner of the elimination stage, and thus a tournament winner.

A key difference between the contest stage and elimination stage is the use of pitchers and catchers. During elimination games, the teams choose to switch from mechanical pitching machines or TDPs, and instead each team may be required to use a catcher and a pitcher from the team roster, referred to as a Tournament Pitcher ("TP"). To lessen the chance of injury or overstrain, each TP has a personal limitation on the number of pitches pitched. The ideal number of pitches to limit a TP to is sixty pitches per tournament, although a range of pitches from forty to eighty per tournament is foreseeable. The pitching limit applies regardless of how many teams the TP plays with.

A TP pitches against the opposing team, rather than his or her own team. There is no minimum pitch speed.

Turning to the game environment, the playing field may be natural grass or artificial turf.

Each game is optionally played within an enclosure to contain the hit balls. Each enclosure will be surrounded by netting on all four sides and the top.

A multiplicity of enclosures will make up the fields required for the tournament. The enclosures are versatile, and thus able to be set up indoors or outdoors, changing any sufficiently large area into a baseball tournament.

Discussion will now turn to a detailed description of the tournament system.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
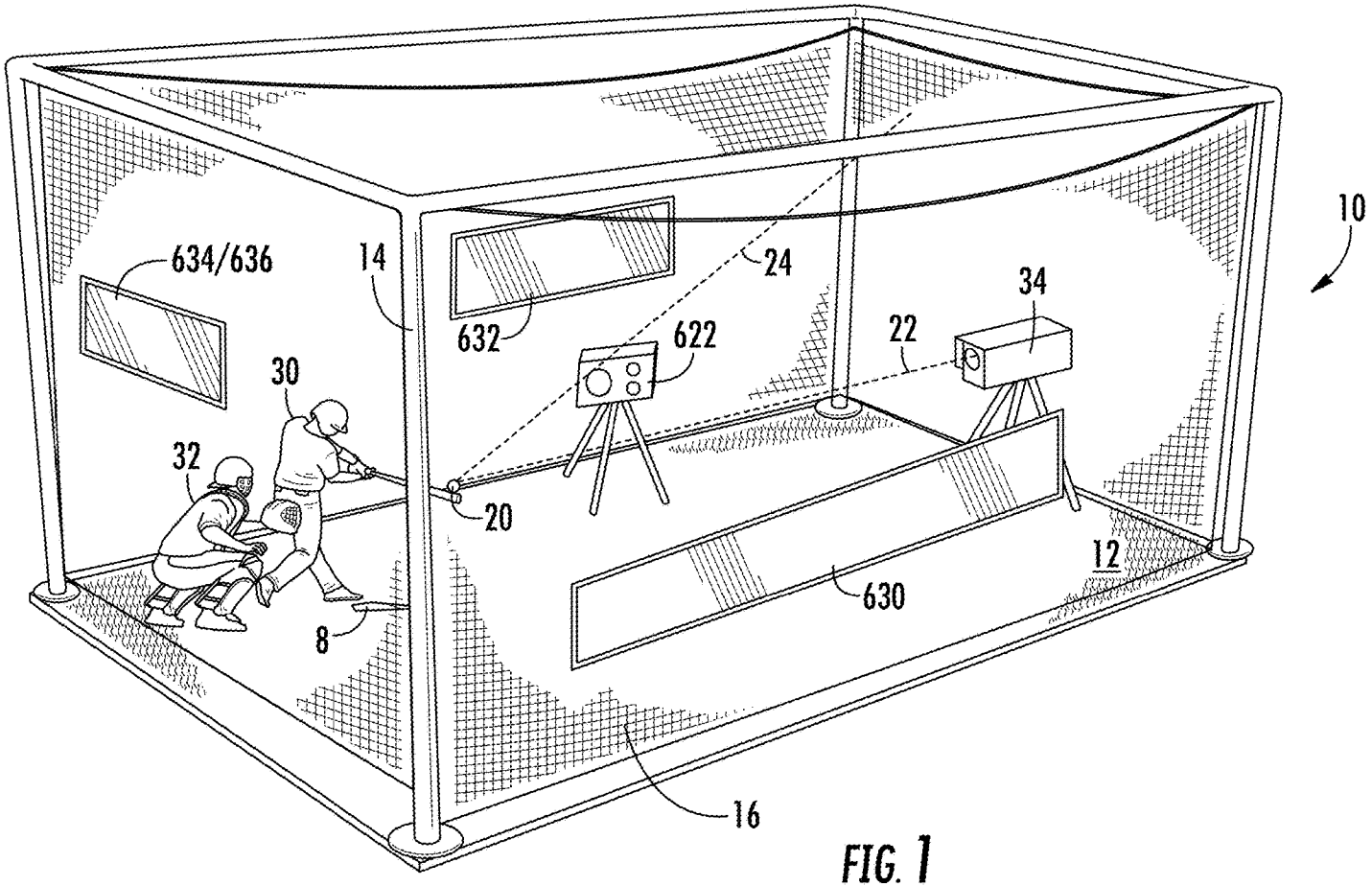
FIG. 1 illustrates a schematic view of an exemplary baseball field used within the tournament.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a typical cage is shown.

The field 10 includes grass or turf 12, surrounded by an enclosure 14. The enclosure 14 includes netting 16 to keep any ball 20 from leaving the field 10.

A batter 30 and catcher 32 stand at a home plate 8, prepared to receive the ball 20 from the pitcher or pitching machine 34. The ball 20 travels a pitched path 22 and a hit path 24, each of which is within view of the DAPP Sensors 622.

As will be explained in further detail below, the DAPP System 500 (not shown) processes the information received from the DAPP sensors 622, subsequently displaying information on the DAPP gameplay status display 630, scoreboard 632, and one or more field displays 634/636.

Figure 2:
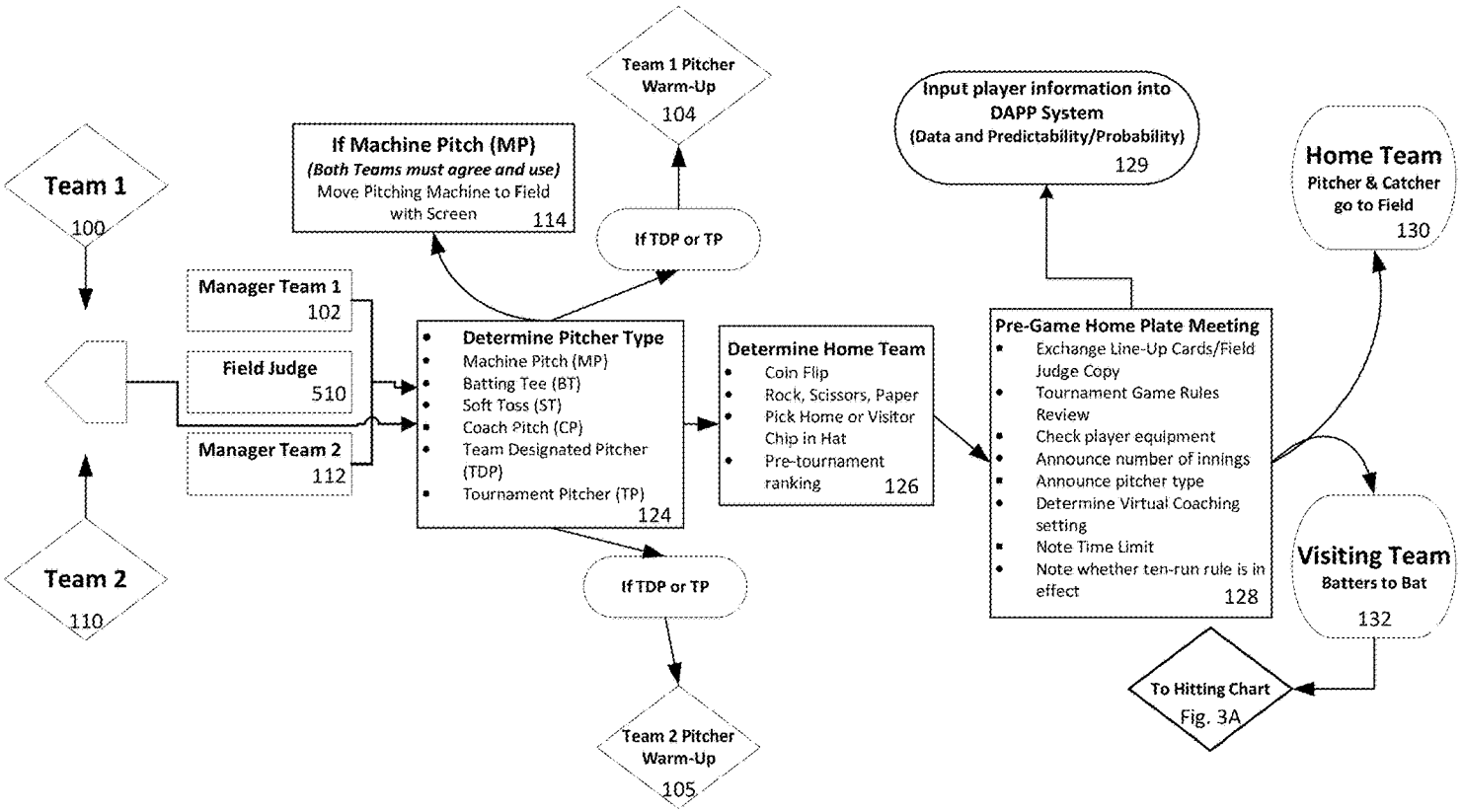
FIG. 2 illustrates a flow chart of the pregame steps.

Referring to FIG. 2, a flow chart of the pregame steps is shown. Two teams, team one 100 and team two 110, are matched for a game. Each team 100/110 has a Team Manager 102/112. A Field Judge 510 manages the flow of the game and steps in when the DAPP 500 cannot make a determination. This interaction is discussed further below.

The appropriate pitcher is then determined 124. If the game is a contest game, the pitcher may be a Machine Pitcher ("MP"), Team Designated Pitcher ("TDP"), Batting Tee ("BT"), Soft Toss ("ST"), or Coach Pitch ("CP").

If the chosen pitcher is a Machine Pitch, the machine must be moved to the field with a protective screen, 114.

If the game is an elimination game, the pitcher is a Tournament Pitcher ("TP"). An exception may be made for very young players, for whom both stages may use a Batting Tee ("BT"), Machine Pitcher ("MP"), Soft Toss ("ST"), Coach Pitch ("CP"), or a Team Designated Pitcher ("TDP"), and never progress to a Team Pitcher ("TP").

If the pitcher is any other than a BT or MP, then the pitcher for each team moves to warm up, 104/105.

The teams then determine 126 which team will act as home team. The goal is a fair process, such as coin flip, rock/paper/scissors or picking a Home or Visitor chip out of a hat, or it may be determined by a pre-tournament ranking of the teams based on various factors.

Once the home team is determined, there is a pre-game home plate meeting 128. The teams exchange line-up cards and provide the Field Judge with a copy. The Field Judge 510 reviews the tournament game rules, player equipment is checked, teams are notified how many innings will make up a regulation game, whether there is a game completion time limit and/or if there is a ten run rule in force, which pitcher type is agreed upon and if the Virtual Coaching option is turned on or off. The Virtual Coaching setting determines whether the DAPP System 500 will accept input during the game from the team members and/or their coaches, taking this input and affecting the determination of play behaviors. For example, whether a team may prompt a virtual player on base to steal a base, or whether a coach may shift his virtual outfielders to compensate for the hitting tendencies of the current batter. Such input is shown on FIG. 7, inputs 640 and 642.

Returning to FIG. 2, sing the information on the line-up cards, and if required, additional information provided prior to the tournament, the DAPP System receives player inputs 129. The DAPP System 500 aggregates the player inputs with any existing information to create player profiles, which are then used to make certain in-game determinations.

With the player information input in the DAPP System, the game may begin. The home team moves to the field, 130, and the visiting team prepares to bat, 132.

Figure 3A:
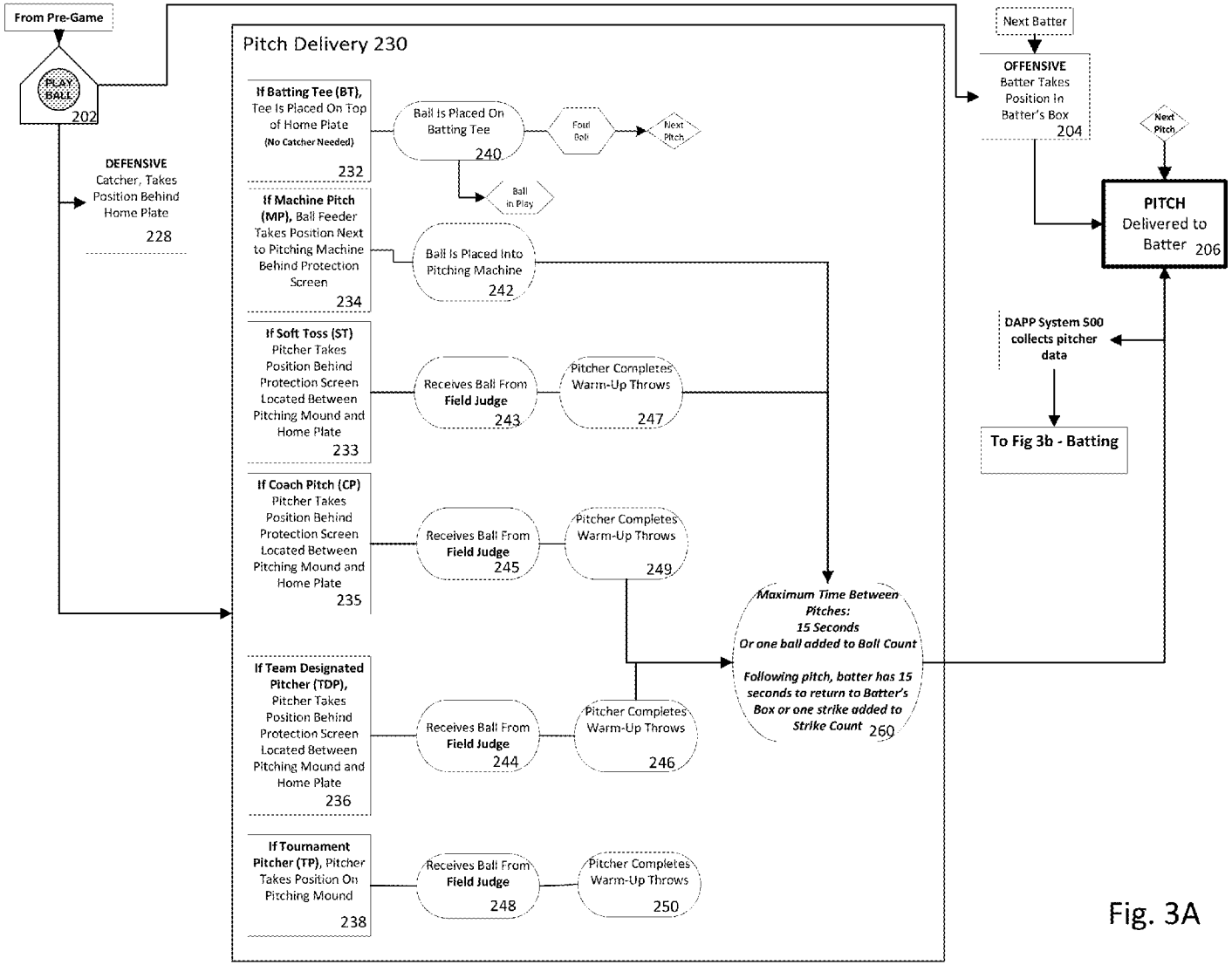
FIG. 3A illustrates a flow chart of the pitching steps for playing a game.

Referring to FIG. 3A, a flow chart of the pitching steps for playing a game is shown.

The game is started, and the teams can play ball 202. The pitcher and catcher 228 of the home team move to the field, and the batter 204 of the visiting team prepares to bat.

The next step depends on the type of pitch delivery 230 chosen for the game. If pitch delivery is by a BT, the tee is set up 232. A ball is then placed on the tee 240. The batter hits the ball, resulting in either the ball being in play, or a foul ball. The scenarios of the ball in play are discussed further below.

If pitch delivery is by a ST, the pitcher takes a position behind a protection screen at a predetermined distance between the pitching mound and home plate, 233. The Field Judge delivers the ball 242, and the pitcher completes warm-up throws 247, if needed.

If pitching is by CP, the pitcher takes a position behind a protection screen at a predetermined distance between the pitching mound and home plate, 235. The Field Judge delivers the ball 243, and the pitcher completes warm-up throws 249, if needed.

If pitch delivery is by a MP, a ball feeder, or individual to feed balls, takes position next to a pitching machine 234 behind a protection screen. The ball feeder inserts a ball into the ball feeder 242.

If pitch delivery is by a TDP, the pitcher takes position on the mound behind a protection screen 236. The Field Judge delivers the game ball 244, and the pitcher completes warm-up throws 246, if needed.

If a TP, the pitcher takes position on the mound 238. The Field Judge delivers the game ball to the pitcher 248, and the pitcher completes warm-up throws 250, if needed.

For any scenario above, other than the use of a BT, the next step is to deliver the pitch 260. The pitch delivery is optionally required to be within 15 seconds or less of receiving the ball. Limiting the time the pitcher can wait to pitch increases the speed of the game. Waiting longer than the permitted fifteen seconds results in a ball being added to the batter's count.

Additionally, following a pitch, the batter is optionally required to return to the batter's box within fifteen seconds or he incurs a strike.

After pitch delivery, 206, the DAPP System 500 monitors the ball, gathering information on pitch speed, path, and so forth. This information is gather and stored.

Figure 3B:
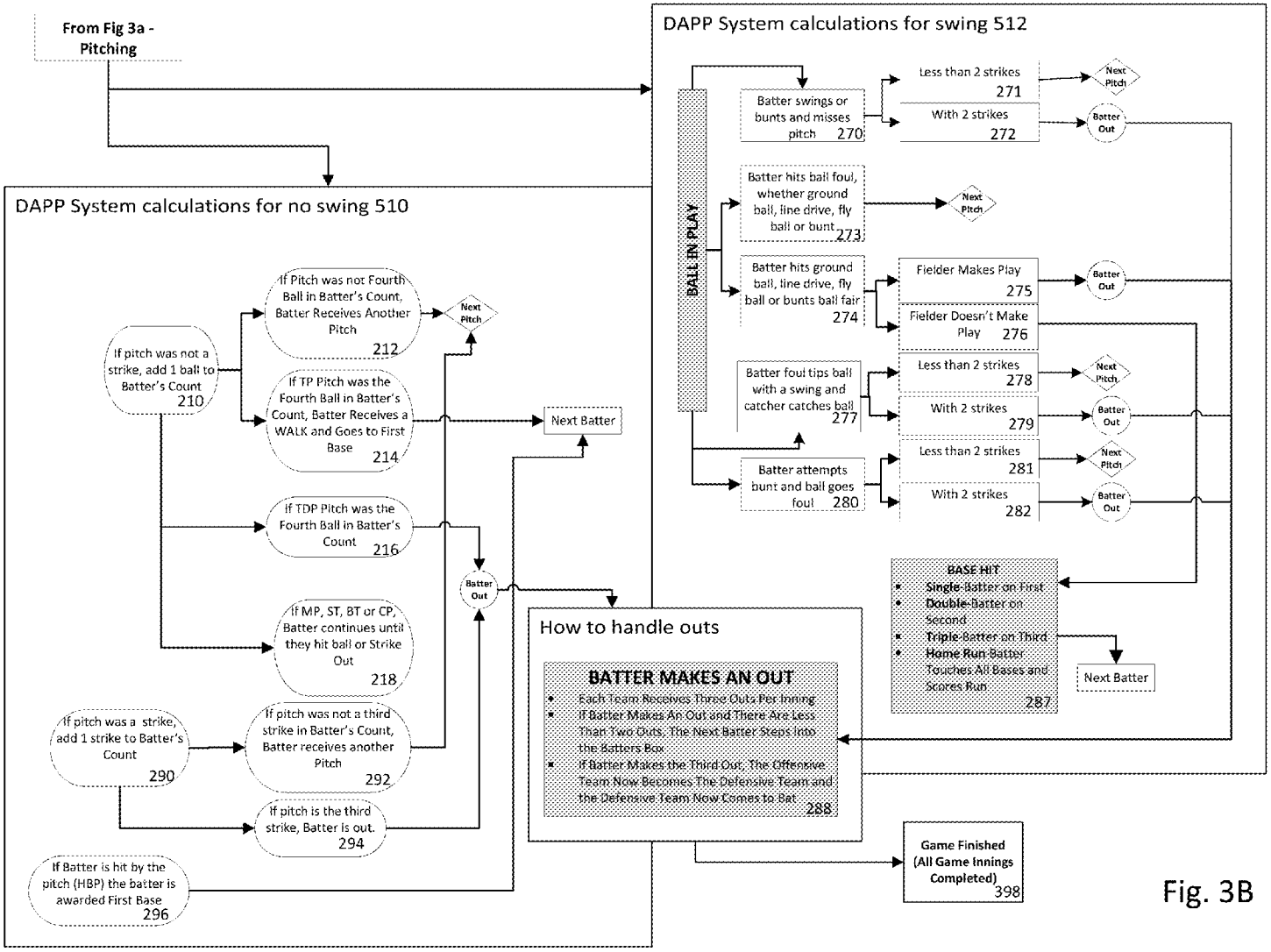
FIG. 3B illustrates a flow chart of the batting steps for playing a game.

Referring to FIG. 3B, a flow chart of the batting steps for playing a game is shown.

Once the ball passes from the pitcher to the batter, the batter must choose whether to swing at the ball.

There are numerous calculations performed by the DAPP System 500 depending on whether the batter does not swing, 510, or does swing, 512.

If the batter does not swing, and the DAPP System determines that the pitch was not a strike, one ball is added to the hitters count, 210. If not the fourth ball, 212, then the next pitch is thrown. If the fourth ball, 214, as counted by the DAPP System 500, the batter receives a walk, and the next batter is up.

If the ball was a strike, as determined by the DAPP System 500, then a strike is added to the batter's count, 290. If not a third strike, then batter receives another pitch, 292. If a third strike, batter is out, 294, and next batter is up if this was not the Hitting team's third out.

If the batter swings or bunts and the DAPP System 500 determines that the batter missed, 270, if the batter has fewer than two strikes, 271, as recorded by the DAPP System 500, then another pitch is delivered. If the batter has two strikes, 272, as recorded by the DAPP System 500, then the miss constitutes the third strike and the batter is out.

If the batter swings and hits a ball foul 273, as determined by DAPP System 500, then another pitch is delivered, this continues until the batter either hits the ball fair, strikes out or walks.

If the batter swings and hits a fair ball, 274, and the fielder makes the play, 275, as determined by the DAPP System 500, the batter is out. If the fielder does not make the play, 276, the DAPP System uses the sensor inputs to calculate whether the hit would constitute a single, double, triple, or home run, 287.

If the batter foul tips the ball with a swing and the catcher catches the ball, 277, with less than two strikes, 278 a next pitch is thrown. With two strikes, 279, the batter is out.

If the batter attempts to bunt the ball and either misses the ball or the ball is bunted foul, 280, if the batter has fewer than two strikes, 281, as recorded by the DAPP System, then another pitch is delivered. If the batter has two strikes, 282, as recorded by the DAPP System 500, then swings and misses, or attempts to bunt and misses, the bunted ball is foul constitutes the third strike and the batter is out.

For any of the above scenarios where the batter swings, the subsequent steps depend on whether there are two or fewer outs. Once a team reaches three outs the sides switch, unless there are no more innings to play. For less than three outs, the next batter advances to the plate.

When the game has reached the desired number of innings, 398, of at least two innings but no more than eight, the system advances to determining how to end the game, which is explained below.

For any above scenario, the DAPP System must record data for a pitch and/or a swing in order to make a determination of the outcome. If the DAPP System fails to record a pitch, or fails to record a swing where a swing was made, the Field Judge will declare a "No Pitch." The pitch and/or hit will be ignored, and a new pitch thrown.

Figure 4:
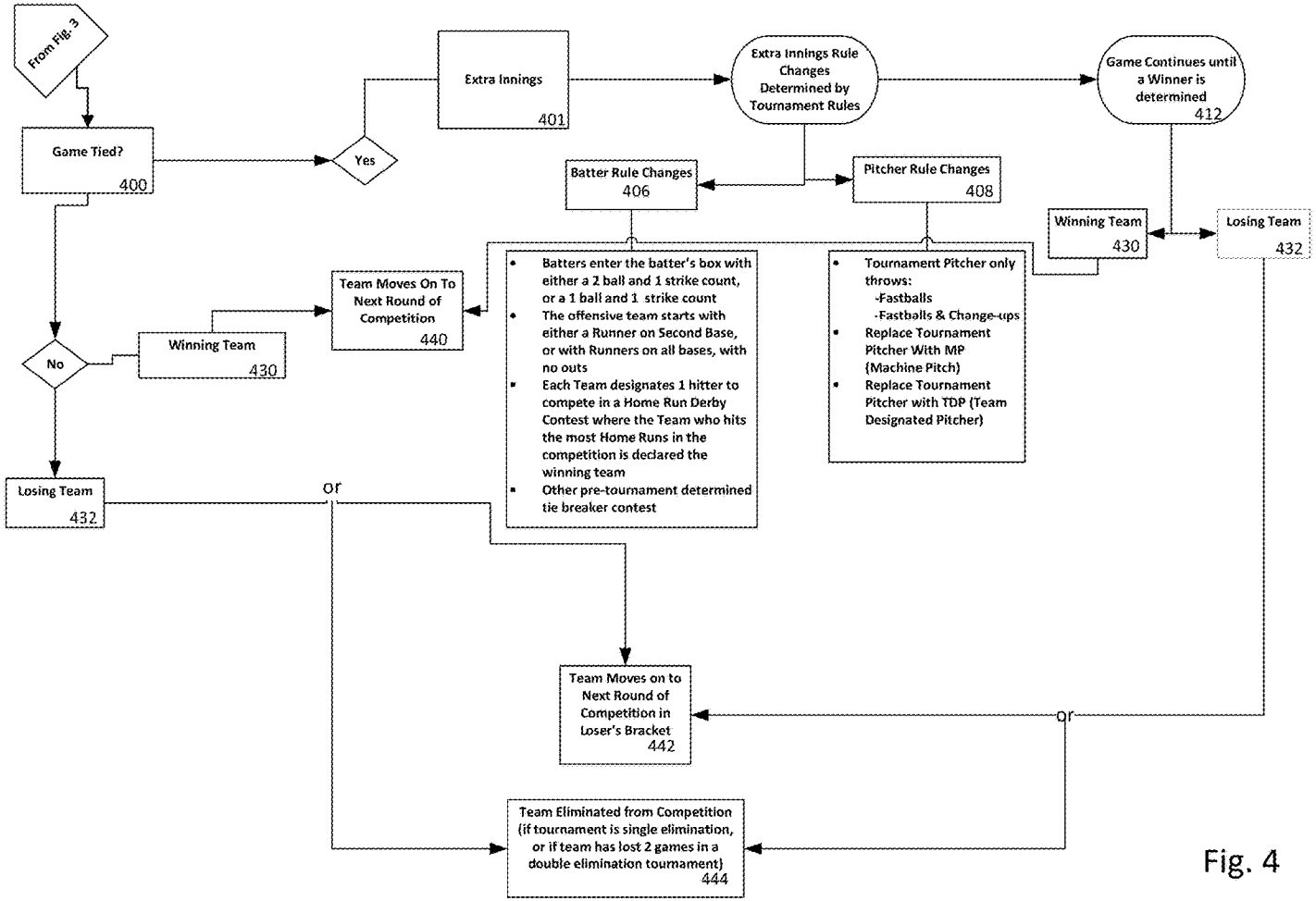
FIG. 4 illustrates a flow chart of the steps for determining how to complete a game.

Referring to FIG. 4, a flow chart of the steps for determining how to complete a game is shown.

If all innings are complete, the issue is whether the score is tied, 400. If the score is not tied, then extra innings are not needed, and a winning team, 430, and losing team, 432, are declared. The winning team, 430, moves on to the next round, 440.

The losing team, 432, moves on to the next round of competition in the loser's bracket, 442, or is either eliminated from competition, 444.

If the teams are tied, then additional innings will be required to break the tie. The extra innings, 401, may be played under revised batter rules, 406. For example, that the batter starts at bat with a two ball and one strike count.

Or the extra innings may be played with pitcher rule changes, 408. For example:

a) Pitchers may be required to throw only fastballs;
b) Pitchers may be required to throw only fastballs and change-ups;
c) Pitchers may be replaced with a Machine Pitcher ("MP") or a Team Designated Pitcher ("TDP"), or;
d) Batters may enter the batter's box with a two ball and one strike count already in force;
e) Any combination of d and a/b/c The game subsequently continues until a winner is determined, 412, with the winning team, 430, and losing team, 432, are declared. The winning team, 430, moves on to the next round, 440.

The losing team, 432, moves on to the next round of competition in the loser's bracket, 442, or is either eliminated from competition, 444.

Figure 5:
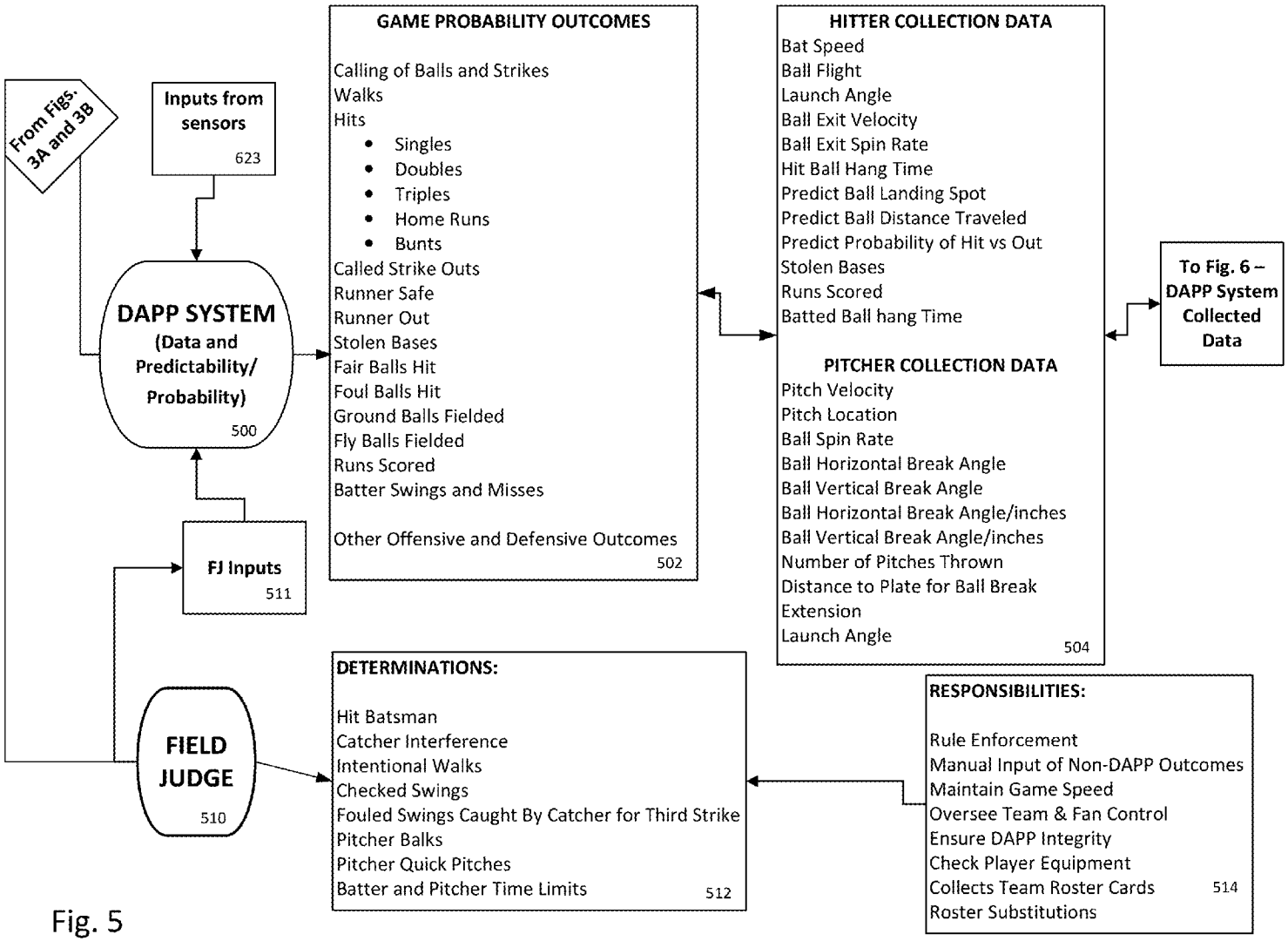
FIG. 5 illustrates a division of responsibilities between the DAPP System and a human Field Judge.

Referring to FIG. 5, a division of responsibilities between the DAPP System and a human Field Judge is shown.

The DAPP System 500 is the primary monitor of all events within the game. The Field Judge 510 is intended to supplement the DAPP System 500.

The DAPP System has two primary responsibilities: determining outcomes of plays within the game, 502, and collecting player data, 504.

As an example of determining outcomes of plays within the game, when a batter hits the ball and becomes a runner, the DAPP System 500 makes numerous determinations. The runner will advance to a base, when batter hits:

a ground ball;
in fair territory; or
that is past or outside the range of the defensive fielder's range.

The DAPP System 500 uses the data inputs from its sensors 623 to determine the type of ball (ground, fly, etc.), the location the ball is hit (fair or foul), and whether a fielder would have reached the ball prior to the ball contacting the ground.

The potential inputs from sensors 623 include data from accelerometers, 3D Doppler radar systems, radar guns, cameras, and camera arrays. The inputs from sensors 623 are used to determine ball flight, trajectory, spin rate, launch angles, pitching velocity, exit velocity, hang time, landing spot, and distance traveled. This data is logged as part of the hitter/pitcher collection data 504. Using this data, along with past player data, calculations are performed to determine outs, whether a runner is safe or out, whether the batter gets a hit, the fielders get a double play, walk, strike, ball, stolen bases, or other offensive or defensive outcomes using prediction algorithms software and technology.

For example, following a hit, if the ball would not have been caught, the DAPP System 500 then determines how many bases the runner would have reached before stopping, and thus whether the hitter is awarded a single, double, triple or a home run.

The DAPP System 500 rapidly makes these determinations, eliminating the need for players in the field, or for the batter to run the bases. The result is greatly increased game speed, and thus decreased game time.

The DAPP System 500 tracks runners, awarding runs to the batting team.

To maintain the gameplay speed, no appeals of the determinations made by the DAPP System 500 are permitted. Thus, every decision of the DAPP System 500 is a final decision.

The exception to that rule is when a Field Judge 510 makes an independent determination that conflicts with the DAPP System 500, or the DAPP System 500 is unable to make a determination.

The Field Judge 510 may then provide FJ Inputs 511 to the DAPP System 500, overriding or supplementing the DAPP System 500 determination. In the case where the DAPP System 500 is unable to make a determination due to an error in collecting the pitcher's or batter's data, the FJ may determine the offensive or defensive outcome as "No Play" and will require the play to be repeated or as a "do over."

For example, Game Probability Outcomes 502 include many items discussed above, including walks and hits. But the DAPP System 500 cannot determine whether the batter has been hit by a ball, or the catcher has interfered with the batter, and so forth. Thus, these determinations 512 are made by the Field Judge 510, and Field Judge Inputs 511 passed to the DAPP System 500.

Additionally, the Field Judge 510 has responsibilities 514 that include enforcing the rules and maintaining the speed of the game. These responsibilities 514 require human judgement, and thus are best performed by the Field Judge 510.

Figure 6:
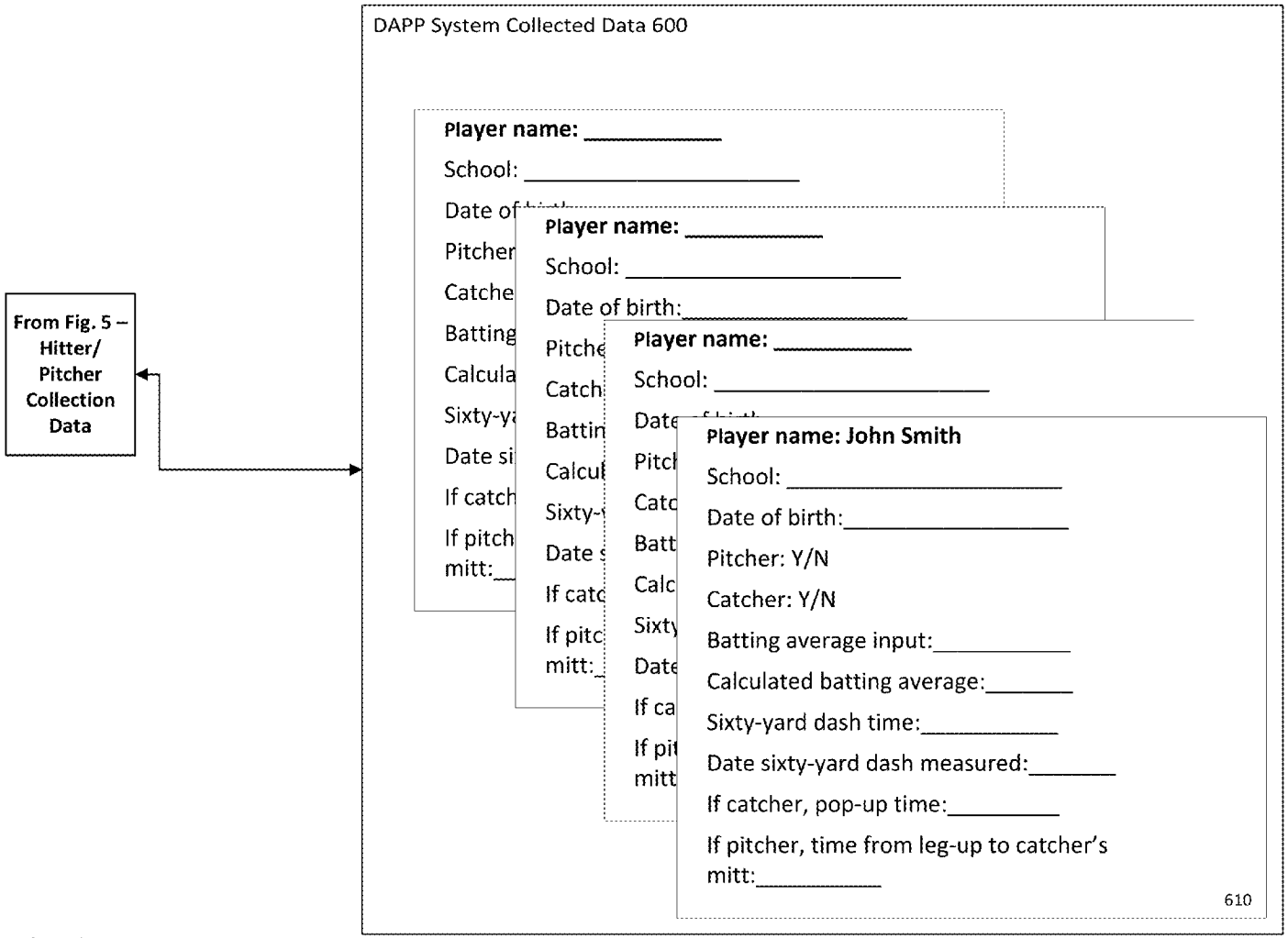
FIG. 6 illustrates sample data held by an exemplary DAPP System.

Referring to FIG. 6, sample data held by an exemplary DAPP System is shown.

Within the DAPP System 500, data, both collected by the DAPP System 500 and input manually, is associated with each player. The DAPP System Collected Data 600 includes subsets of data divided by player, each player's data held on a virtual card 610 or player record. Each virtual card 610 includes personal identifying information, such as name, school, and date of birth. Further included is data regarding player positions, batting statistics, and other information.

The gathered information is used as both an input to, and an output from, the DAPP System calculations. For example, each time a player bats, the information on hits, strikes, etc. is collected by the DAPP System and recorded in the appropriate virtual card 610. The collection and organization of this data is useful for players and coaches as they track progress and determine team lineups.

Furthermore, the data is used to calculate outcomes. For example, the DAPP System knows which players are playing defense, and out in the field. The statistics of each player can be inputs into the DAPP System 500, affecting whether the DAPP System 500 decides that a given ball will be caught by a fielder, or whether the fielders are not fast enough to reach the ball before it contacts the field.

Additionally, the data can be used as inputs for stolen bases. Each team is provided with an input, such as team one input 640 and team two input 642 in FIG. 7, that is used to provide input to the DAPP System 500. The controller may be used to indicate that a team wishes to steal a base, for example by using the runner on second base to steal third base. The DAPP System 500 knows which runner is on second base, who is pitching, and who is catching. If the DAPP System 500 knows the ten, twenty, forty, or sixty-yard dash time of the player on second base, it can calculate whether the runner is fast enough to reach third base before the ball. The calculation uses the pitcher's recorded pitch time and the catcher's pop-up time, or time to receive a ball and stand up and deliver to a base. If the runner's time is less than the time for the pitcher to throw and the catcher to deliver to the base, then the runner takes the base. If not, the runner is out.

Figure 7:
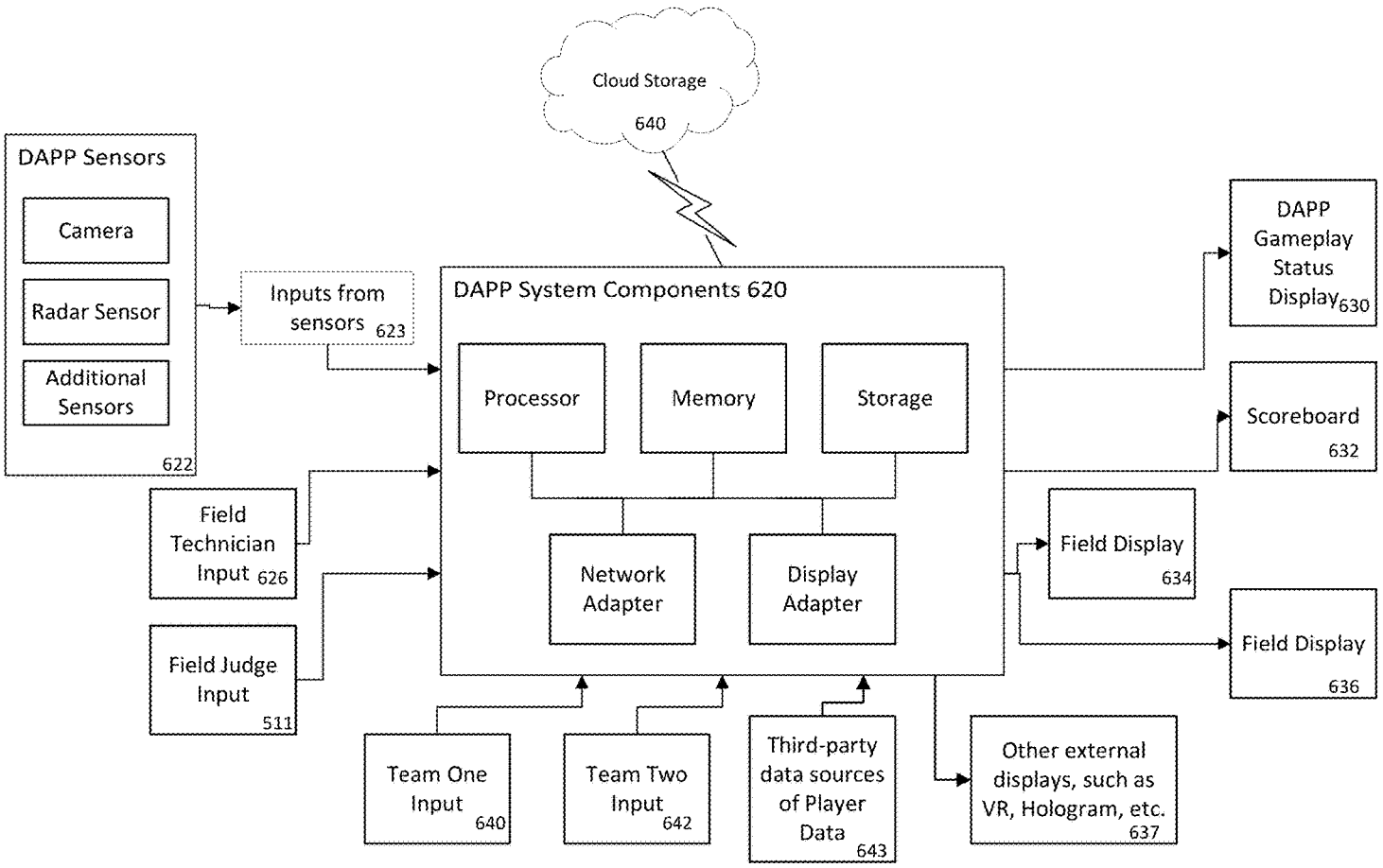
FIG. 7 illustrates inputs, outputs, and internal hardware of an exemplary DAPP System.

Referring to FIG. 7, inputs, outputs, and internal and external hardware, as well as connectivity to other data technology that can provide other useful player data of an exemplary DAPP System are shown. The DAPP System Components 620, along with the other pieces discussed below, make up the DAPP System 500.

The DAPP System Components 620 include a processor, memory, storage, network adapter, and display adapter. The DAPP System Components may communicate with cloud storage 640 using the Internet. DAPP Sensors 622, including cameras, microwave, laser and radar sensors, among other types of sensors, create inputs from sensors 623 that pass to the DAPP System Components, 620.

A field technician input 626 may be used by a field technician to troubleshoot. The field judge input 511 allows the Field Judge 510 to input information into the DAPP System 500 to override a DAPP System decision, or to provide information the DAPP System is unable to gather.

The DAPP System Components 620 output to a DAPP gameplay status display, which includes virtual baseball field, player information, and so forth, 630.

The scoreboard 632 includes the runs, outs, balls, and other related information.

One or more field displays 634 and 636 provide more basic information, allowing the players to determine when they are to bat, and other player-centric information.

Other optional outputs include VR (Virtual Reality) displays, holograms, and so forth, that may be used to depict the virtual action on the field.

Each team may have an input, in the form of team one input 640 and team two input 642 that allows the teams to provide the DAPP System with inputs. For example, when a player wishes to attempt to steal a base or shifting defensive players to match a batter's hitting tendencies.

Third-party sources of player data, 643, may also serve as input to the DAPP System. Such additional player data can aid the DAPP System in its determinations of fielder behavior and abilities.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of conducting a baseball tournament between baseball teams, the baseball tournament having a contest stage and an elimination stage, an electronic Data And Predictability Probability ("DAPP") System used to determine the outcome of each instance of a player at-bat, the baseball teams made of players, the method comprising:

a. matching a first set of baseball teams into opposing pairs of teams;

b. playing the opposing pairs of teams of the first set of baseball teams against one-another in a set of contest games;

i. the contest games using a pitcher selected from the group of: batting tee, soft toss, coach pitching, pitching machine, or a team-designated pitcher;

ii. during play, the DAPP System identifying each batter as he prepares to bat;

1. the batter identified using player order, or input via a field judge input or a coach input;

2. a player data file opened for the identified batter, the DAPP System prepared to save data to the player data file;

iii. after the ball is hit by the batter, the DAPP System taking sensor input from one or more sensors;

1. the DAPP System using the sensor input to determine ball trajectory, spin, and velocity;

2. the DAPP System saving the ball trajectory, spin, and velocity data in the player data file;

3. the DAPP System using input from one or more sensors to determine balls, strikes, and the probability of base hits;

iv. repeating step b, each time removing the losing team from the tournament until a predetermined number of teams remains, the predetermined number of teams forming a second set of teams;

c. matching the second set of baseball teams into opposing pairs of teams;

d. playing the second set of baseball teams against one-another in elimination games;

i. the elimination games using a second pitcher, the second pitcher selected from the group of: batting tee, soft toss, coach pitching, pitching machine, or a team-designated pitcher;

ii. during play, the DAPP System identifying each batter as he prepares to bat;

1. the batter identified using player order, or input via a field judge input or a coach input;

2. a player data file opened for the identified batter, the DAPP System prepared to save data to the player data file;

iii. after the ball is hit by the batter, the DAPP System taking sensor input from one or more sensors;

1. the DAPP System using the sensor input to determine ball trajectory, spin, and velocity;

2. the DAPP System saving the ball trajectory, spin, and velocity data in the player data file;

3. the DAPP System using input from one or more sensors to determine balls, strikes, and the probability of base hits;

iv. repeating step d until only a single team remains;

v. outputting the outcome to one or more displays.

2. The method of claim 1, wherein the pitcher for the elimination games is a team-designated pitcher, a team-designated pitcher being a pitcher who is also a player on one or more of the baseball teams.

3. The method of claim 2, wherein the team-designated pitcher is only permitted to pitch a fixed number of pitches per baseball tournament.

4. The method of claim 3, wherein the fixed number of pitches per baseball tournament is sixty pitches.

5. The method of claim 1, wherein the determinations of the DAPP System are optionally overridden by a field judge input, the field judge input resulting from decisions made by a human judge.

6. The method of claim 1, further comprising the following sub-steps within step b:

i. during play, when prompted via a team input, the DAPP System predicting stolen bases by:

1. reading data from within the player data files for the batters, including each player's running speed for ten, twenty, thirty, forty, or sixty yard sprint times;

2. reading data from within the player data files for the pitcher, including recorded throw times from the pitcher to the catcher from a set position; and 3. calculating the probability that a batter can traverse the distance between two bases prior to being thrown out by the pitcher or catcher.

7. A method of conducting a baseball tournament in which determinations of hits and runs are made by a Data And Predictability Probability ("DAPP") System rather than a human umpire, and the method of pitching changes as the tournament progresses, the method comprising the steps of:

a. matching a first team and a second team to play a game against each other;

i. each team composed of between two and twelve individual players;

b. determining what type of pitching to use;

i. if the game is a contest game, then either a Machine Pitcher ("MP") or a Team Designated Pitcher ("TDP") is used, where a MP is an automated pitcher, and a TDP is a pitcher who pitches against his own team but is not a player;

ii. if the game is an elimination game, then a Tournament Pitcher ("TP") is used, where a TP is a pitcher who is also a player, and pitches against batters of an opposing team;

c. determining whether the first team or the second team will bat first;

d. sending a batter to the plate from the team chosen to bat first;

e. pitching a baseball to the batter using the MP, TDP, or TP, as determined above;

f. the DAPP System collecting and processing baseball trajectory and speed of the baseball after being pitched by:

i. gathering sensor input from one or more sensors;

1. the one or more sensors tracking the path of the baseball;

2. the sensor input used by the DAPP System to calculate the speed and trajectory of the baseball;

ii. determining whether the baseball constitutes a ball or strike by processing the input from the one or more sensors;

g. collecting data regarding the speed and path of the baseball using one or more sensors after the baseball is hit by the batter;

h. the DAPP System collecting and processing the data regarding the speed and path of the baseball after being hit by:

i. gathering sensor input from one or more sensors;

1. the one or more sensors tracking the path of the baseball;

2. the sensor input used by the DAPP System to calculate the speed and trajectory of the baseball;

ii. predicting an outcome of the baseball after being hit based on locations and performance abilities of virtual fielders; and;

iii. outputting the outcome to one or more displays.

8. The method of claim 7, wherein the pitcher is a team-designated pitcher ("TDP"), a team-designated pitcher being a pitcher who is also a player on one or more baseball teams.

9. The method of claim 8, wherein the team-designated pitcher is only permitted to pitch a fixed number of pitches per baseball tournament.

10. The method of claim 9, wherein the fixed number of pitches per baseball tournament is sixty pitches.

11. The method of claim 7, further comprising the following sub-steps within step b:

i. during play, when prompted by a team input, the DAPP System predicting stolen bases by:

1. reading data from within the player data files for the batters, including each player's running speed for ten, twenty, thirty, forty, or sixty yard sprint times;

2. reading data from within the player data files for the pitcher, including recorded throw times from the pitcher to the catcher from a set position; and 3. calculating the probability that a batter can traverse the distance between two bases prior to being thrown out by the pitcher or catcher.

12. A baseball tournament system for use determining the outcome of baseball games between a first team and a second team, the baseball tournament system comprised of:

a. a Data And Predictability Probability ("DAPP") System that includes:

i. one or more sensors to track the position, speed, and path of a baseball, each of the one or more sensors selected from the group of: camera, microwave sensor, laser sensor, ultrasonic sensor, radar sensor;

ii. a processor, a memory component, a storage component, a network adapter, and a display adapter;

b. the storage component of the DAPP System including data in the forms of:

i. player records, or data regarding the past performance for each player who is a member of the first team or the second team;

1. for every player, the data within the player record including a sprint time over a fixed distance; and 2. for every player who is a pitcher, the data within the player record including the delivery time for a pitch from the leg-up position of the pitcher to the catcher's mitt ("delivery time");

3. for every player who is a catcher, the data within the player record including the time for the catcher to stand up and throw to second or third base ("pop time");

ii. whereby as sensor data is collected from a baseball, the sensor data is added to the matching player record;

c. the DAPP system outputting to one or more field displays and one or more scoreboards.

13. The baseball tournament system of claim 12, wherein each player record includes an input batting average, and a calculated batting average based on data collected by the DAPP System during gameplay.

14. The baseball tournament system of claim 12, further comprising:

a. a team one input, permitting one or more members of the first team to make inputs to the DAPP System; and b. a team two input, permitting one or more members of the second team to make inputs to the DAPP System;

c. the team one input and team two input influencing certain calculations made by the DAPP System, such as a position of virtual fielders.

15. The baseball tournament system of claim 12, wherein i. the DAPP System predicts stolen bases by:

1. reading data from within the player records for a batter, including the batter's running speed for ten, twenty, thirty, forty, or sixty yard sprint times;

2. reading data from within the player records for a pitcher, including recorded throw times from the pitcher to a catcher from a set position; and 3. when prompted by an input to the DAPP System, calculating the probability that a batter can traverse the distance between two bases in a time less the total of the delivery time and the pop time.

16. The baseball tournament system of claim 15, further comprising:

a. a team one input, permitting one or more members of the first team to make inputs to the DAPP System; and b. a team two input, permitting one or more members of the second team to make inputs to the DAPP System;

c. the team one input and team two input prompting the DAPP System to determine the probability of a base being stolen.

* * * * *